United States Patent [19]

Ura et al.

[11] Patent Number: 4,517,804

[45] Date of Patent: May 21, 1985

[54] CONDENSER VACUUM RETAINING APPARATUS FOR STEAM POWER PLANT

[75] Inventors: Katsumi Ura, Kitaibaraki; Taiji Inui; Kenji Sakka, both of Hitachi, all of Japan

[73] Assignee: Hitachi, Ltd., Tokyo, Japan

[21] Appl. No.: 533,802

[22] Filed: Sep. 19, 1983

[30] Foreign Application Priority Data

Sep. 17, 1982 [JP] Japan ..... 57-160853

[51] Int. Cl.[3] ..... F01K 21/00

[52] U.S. Cl. ..... 60/657; 60/693; 277/3

[58] Field of Search ..... 60/646, 657, 690, 692, 60/693; 277/3, 15, 18

[56] References Cited

U.S. PATENT DOCUMENTS 3,235,269 2/1966 Olesen ..... 277/15 X 3,906,730 9/1975 Bellati et al. ..... 60/657

3,959,973 6/1976 Meylan ..... 60/646 X 4,044,561 8/1977 Hohn ..... 60/657

4,290,609 9/1981 Dumont ..... 277/3

4,363,216 12/1982 Bronicki ..... 60/646 X

*Primary Examiner*—Allen M. Ostrager

*Attorney, Agent, or Firm*—Antonelli, Terry & Wands

[57] ABSTRACT

A vacuum retaining arrangement for retaining a vacuum within a condenser of a steam power plant during a short term outage or shutdown. At least a portion of a turbine gland packing near the condenser, with respect to a sealing steam supply portion, is connected and communicated with an air extractor through a gland condenser. The sealing steam which would otherwise flow into the condenser from the turbine gland package is suctioned or extracted from the gland packing into the gland condenser and the air extractor during the short term outage or shutdown so as to prevent the sealing steam from leaking into the condenser.

14 Claims, 6 Drawing Figures

CONDENSER VACUUM RETAINING APPARATUS FOR STEAM POWER PLANT

BACKGROUND OF THE INVENTION

The present invention relates to a power plant and, more particularly, to a steam power plant including an arrangement for retaining a vacuum in a condenser of the power plant during a short term outage or shutdown of the power plant.

In steam power plants, vacuum within the condensers thereof is not usually retained during long term outages or shutdown of the turbines of power plant; however, in short term outages or shutdowns, the steam may or may not be retained depending upon the particular operating circumstances. Both the retention and release of the vacuum have merits and disadvantages.

A disadvantage of retaining vacuum within the condensers of the steam power plant during a short term outage or shutdown of the steam turbines resides in the fact that additional power must be consumed during the outage or shutdown simply to retain the vacuum condition in the condensers, with a large portion of the additional power consumption representing a power loss necessitated by continuous operation of circulating water pumps in the steam power plant.

If, for example, the circulating pumps in the steam power plant are stopped during a short term outage or shutdown of the steam turbine in order to save unnecessary power consumption, the vacuum in an interior of the condensers is broken so that a troublesome restarting operation of the steam power plant is required, which restarting takes a considerably long period of time. Moreover, since condensate water within the condensers comes into contact with the atmosphere and absorbs oxygen, a quality of the condensate water is considerably lowered thereby increasing the rate of corrosion.

The power necessary to operate the circulating pumps to retain the vacuum in condensers of a steam power plant during a shutdown or outage is considerable. For example, with a thermal electric plant of 700 MW, the necessary power to operate the circulating pumps may represent an annual power rate of several million dollars.

In view of recent concerns regarding energy conservation, there has been an increase in the frequency of the shutdowns or outages in steam turbine plants employed for power generation as well as in other plants. More particularly, steam turbines with a combined cycle are subjected to start up and shutdown alternately at a high frequency so that the abovenoted disadvantages appear to a relatively large extent.

For the purpose of reducing power costs during an outage or shutdown, it has been proposed to operate the circulating pumps at about a 50% load to maintain a vacuum in the condenser by, for example, operating either one of two circulating pumps which are adapted to be operated in parallel.

However, a disadvantage of the last mentioned proposal resides in the fact that, since the flow rate of the condenser cooling water is reduced by about one half and, correspondingly, the speed of water is reduced by about one half, contaminants or pollutants such as, for example, microorganisms or marine biology from, for example, ocean cooling water, tend to adhere and collect on inner wall surfaces of the coolant pipes thereby adversely affecting the overall reliability of the entire power plant system and requiring more frequent time consuming cleaning operations of the coolant circulation system.

SUMMARY OF THE INVENTION

The aim underlying the present invention essentially resides in providing a condenser vacuum retaining apparatus for steam power plants which enables a stopping of an operation of a circulating water pump during a short term outage or shutdown of a steam turbine of the power plant while nevertheless enabling a retention of a vacuum within a condenser of the power plant with only a relatively small consumption of power.

In accordance with advantageous features of the present invention, a retaining apparatus is provided wherein a portion of a steam turbine gland packing near the condenser, relative to a sealing steam supply portion, is connected and communicated with an air extractor through a gland condenser, whereby sealing steam, which would otherwise flow into the condenser from the turbine gland packing, is suctioned or drawn off into the gland condenser and the air extractor during a short term outage or shutdown so as to prevent the sealing steam for leaking into the condenser.

Accordingly, it is an object of the present invention to provide a vacuum retention apparatus for steam power plants which avoids, by simple means, shortcomings and disadvantages encountered in the prior art.

Another object of the present invention resides in providing a vacuum retention apparatus for steam power plants which enables a shutdown of the power plant while retaining the vacuum in condensers of the power plant with a minimal power consumption.

Yet another object of the present invention resides in providing a vacuum retention apparatus for steam power plants which functions reliably under all operating conditions.

A further object of the present invention resides in providing a vacuum retention apparatus for steam power plants which is simple in construction and therefore relatively inexpensive to manufacture.

A still further object of the present invention resides in providing a vacuum retention apparatus for steam power plants which minimizes a restart time period following an outage or shutdown of the power plant.

Another object of the present invention resides in providing a vacuum retention apparatus for steam power plants which enables a shutdown of coolant circulating means during an outage or shutdown of the power plant.

A further object of the present invention resides in providing a vacuum retention apparatus for steam power plants which ensures an existence of a vacuum during an entire short term shutdown or outage of the power plant.

Yet another object of the present invention resides in providing a vacuum retention apparatus for steam power plants which ensures that a sealing steam which would otherwise flow into a condenser of the power plant is drawn off into a further condenser and an air extractor to prevent a leakage of the sealing steam into the condenser of the power plant.

Another object of the present invention resides in providing a vacuum retention apparatus for steam power plants which minimizes the contamination of cooling pipes of the cooling system of the plant.

These and other objects, features, and advantages of the present invention will become more apparent from the following description when taken in connection with the accompanying drawings which show, for the purposes of illustration only, several embodiments in accordance with the present invention.

DETAILED DESCRIPTION

Figure 1:
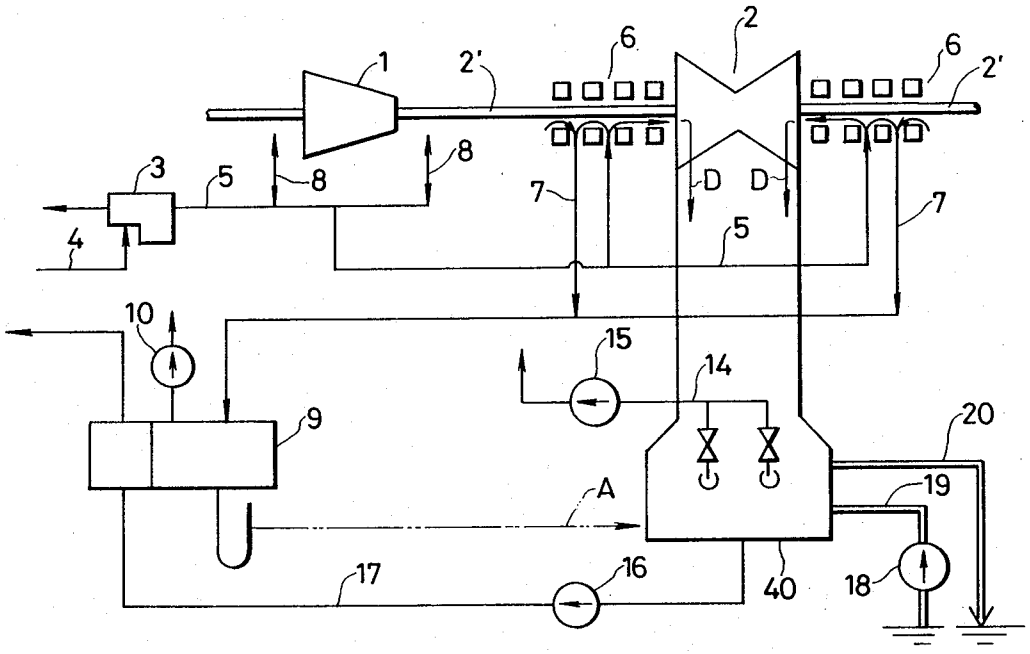
FIG. 1 is a schematic block diagram of a conventional steam power plant equipped with a condenser vacuum retaining apparatus.

Referring now to the drawings wherein like reference numerals are used throughout the various views to designate like parts and, more particularly, to FIG. 1, according to this figure, a conventional steam power plant includes a high pressure turbine 1, a low pressure turbine 2 connected to the high pressure turbine 1, and a gland packing 6 fitted over portions of a shaft 2' of the low pressure turbine 2. With the steam power plant under a standby state occurring, for example, during an outage or shutdown while retaining vacuum, sealing steam 4 is supplied to a gland regulator 3 from an auxiliary steam system connected to an outside or in plant boiler or the like. After a regulation of the sealing steam 4 by the regulator 3 to a constant pressure, the sealing steam 4 supplied, through a sealing steam header 5, to a gland packing 6. A leak 8 from the high pressure turbine 1 is supplied to the sealing steam header 5, and a part of the sealing steam 4 supplied to the gland packing 6 leaks, as shown by the arrows D, into a condenser 40 of the power plant and is then cooled into condensed water, with the condensed water being extracted from the condenser 40 through a condensate pipe 17 by a condensate pump 16. The remaining steam is extracted from outside of the gland packing 6 and is fed to a gland condenser 9 through low pressure turbine condensing or cooling pipes 7. In the condenser 9, the extracted steam is cooled and condensed, with the recovered condensed water being fed from the condenser 9 to the condenser 40 through a feed means A indicated in phatom line. Non-condensed gas is discharged to the atmosphere from the condenser 9 through a fan or blower 10. The condenser 40 is provided with an air extracting pipe 14 and an air extractor 15, and a part of the condensate within the condenser 40 is supplied, as a cooling medium, to the condenser 9 through the condensate pipe 17 by the condensate pump 16.

The sealing steam leaked into the condenser 40 is cooled by cooling water supplied by a circulating water pump 18 and coolant inlet pipe 19 and condensed water from the leaked sealing steam is stored in the condenser 40. The cooling water is returned from the condenser 40 to a cooling water supply through a cooling water return pipe 20. The power required to operate the circulating water pump so as to ensure an adequate and proper cooling is relatively large.

Figure 2:
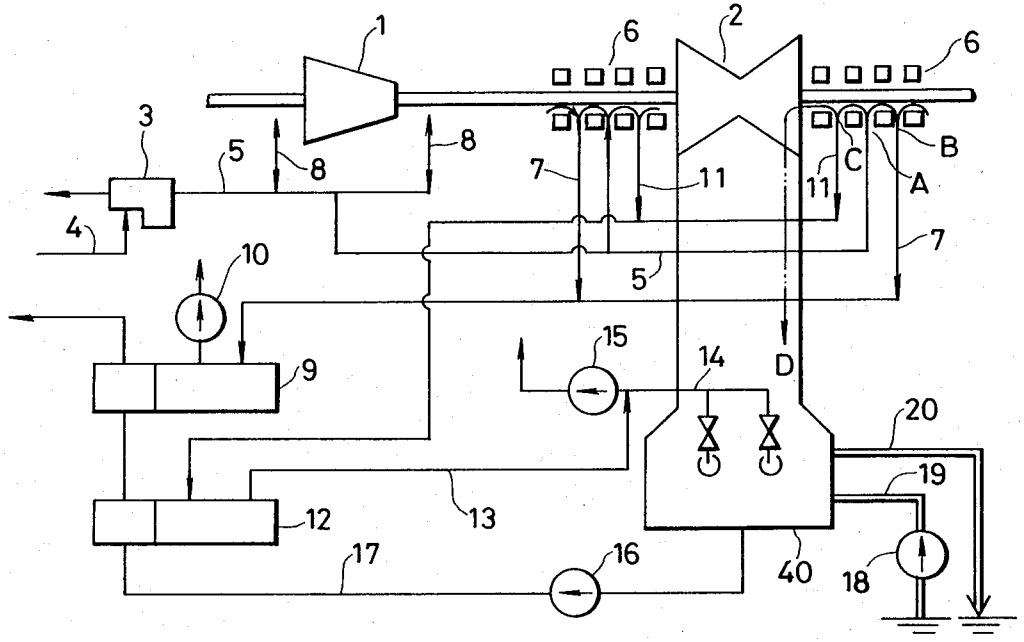
FIG. 2 is a schematic diagram of a steam power plant equipped with a condenser vacuum retaining apparatus constructed in accordance with the present invention.

As shown in FIG. 2, in accordance with the present invention, a second gland condenser 12 is provided for enabling a retention of vacuum, with the second condenser 12 being provided separately from the first condenser 9. As with the power plant described hereinabove in connection with FIG. 1, leaked steam from an extraction port B outside of a sealing steam inlet port A is introduced or supplied to the condenser 9 and condensed therein; however, another extraction port C is provided at a position near the condenser 40 relative to the inlet port A, with the port C being connected to and communicated with the air extractor 15 through a low pressure gland steam pipe 11 and the second condenser 12. The second condenser 12 is connected to the inlet of the air extractor 15 through a connecting pipe 13.

The degree of vacuum attraction induced by the air extractor 15 is generally set so as to be slightly higher than a degree of vacuum within the condenser 40 and, by properly selecting and locating steps of the gland packing 6, it is possible to attract the sealing steam to the second condenser 12 which would otherwise leak into the condenser 40 from the gland packing as indicated by the arrow D. By virtue of the construction illustrated in FIG. 2, the sealing steam is prevented from leaking into the condenser 40 so that the vacuum within the condenser 40 may be held during a shortterm outage or shutdown of the steam power plant even when the circulating water pump 18 is stopped. Consequently, start-up procedures for the steam power plant are relatively simple and the necessary time period for restarting is considerably shortened, while the power consumption during the outage or shutdown is also considerably reduced.

Figure 4:
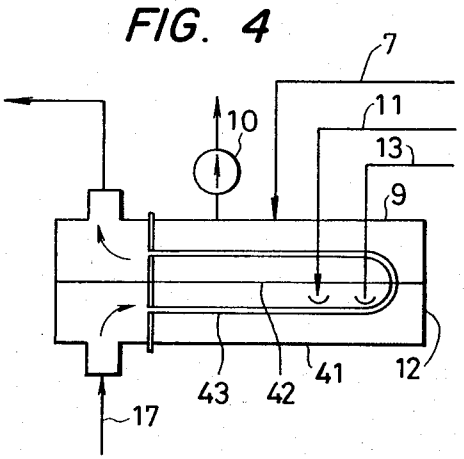
FIG. 4 is a schematic cross sectional view of a combined first and second gland condenser in the steam power plant of FIG. 3.
Figure 3:
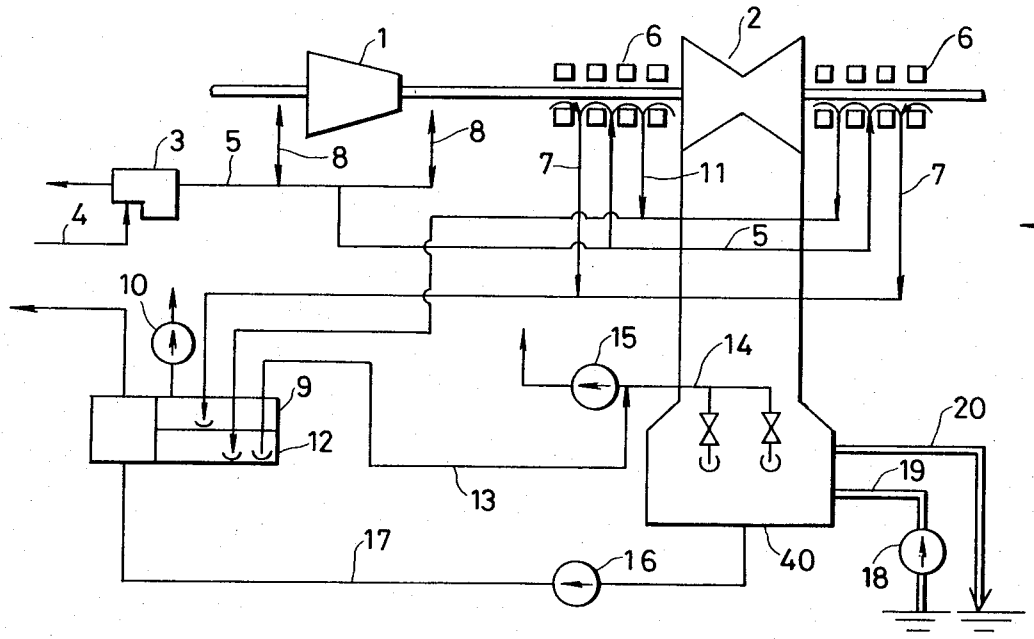
FIG. 3 is a schematic diagram of another embodiment of a steam power plant equipped with a condenser vacuum retaining apparatus constructed in accordance with the present invention.

As shown in FIGS. 3 and 4, it is possible for the first and second condensers 9, 12 to be combined into an integrated unit. The combining of the first and second condensers 9, 12 into an integrated unit is economically advantageous and has a high value when put to practical use. More particularly, generally a condensate water is used as cooling water for the gland condensers and, in many cases, the amount of cooling water is too excessive in comparison with the required amount of heat exchange. Consequently, gland condensers generally tend to become relatively large in diameter and relatively short in axial length. Therefore, a portion of the condensate for cooling is usually bypassed in order to provide for an appropriate shape balance of the gland condensers. The construction proposed in FIGS. 3 and 4 is readily adaptable to situations requiring an additional amount of heat for the second gland condenser just by reducing the bypasses amount of condensate to a certain degree.

As shown most clearly in FIG. 4, in the integrated unit of the condensers 9, 12, a common barrel or cylindrical shaped outer casing 41 is provided and is divided into upper and lower chambers by a partition plate or wall member 42, with an upper chamber forming the first condenser 9 and the lower chamber forming the second condenser 12. Condensate supplied through the condensate pipe 17 is introduced into a substantially U-shaped pipe 43 so as to enable a cooling of the interiors of both the first and second condensers 9, 12. The blower or fan 10 is employed for enabling a discharging of non-condensed gas.

Figure 5:
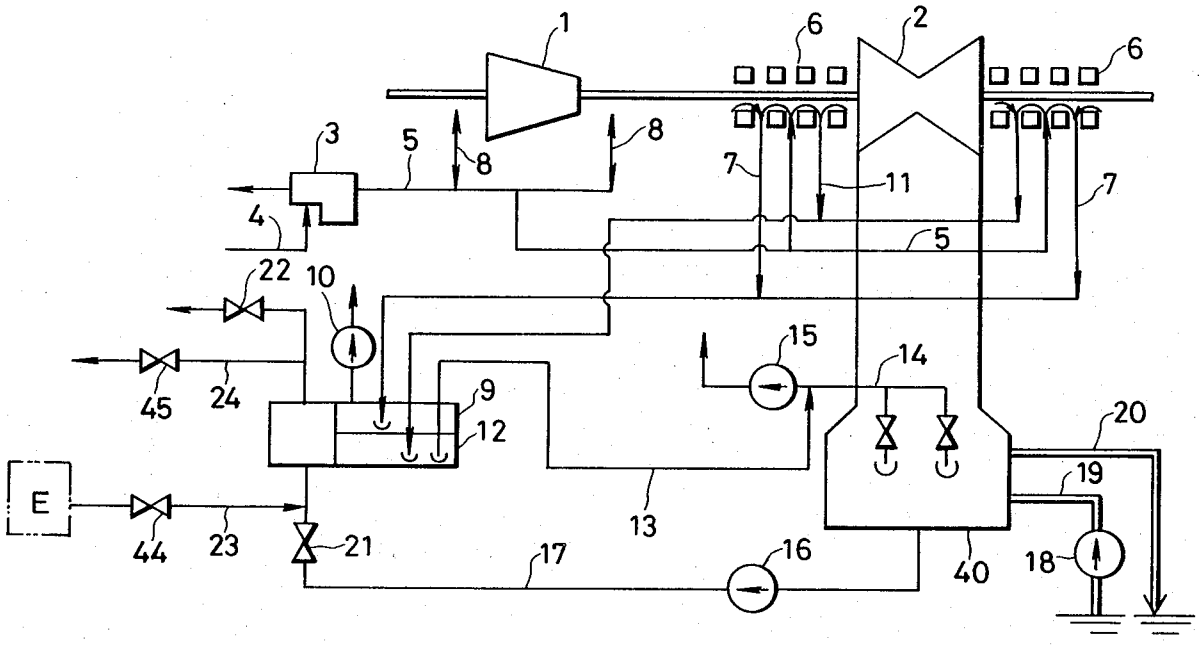
FIG. 5 is a schematic diagram of yet another embodiment of a steam power plant equipped with a condenser vacuum retaining apparatus constructed in accordance with the present invention.

As shown in FIG. 5, it is also possible in accordance with the present invention for a condensate within the condensing pipe 17 or a cooling water from a source E of other systems to be selectively used as a cooling medium for the first condenser 9 as well as the second condenser 12. For this purpose, a gland condenser inlet valve 21 is arranged in the condensate pipe 17, with a gland condenser outlet valve 22 being provided for controlling the discharge of the condensate. The cooling water source E communicates with the condensate pipe 17 at a position upstream of the inlet valve 21 by way of a cooling water supply pipe or conduit 23, with a cooling water supply valve 44 being arranged in the cooling water supply pipe 23. A cooling water return pipe or conduit 24 is provided with a flow of the cooling water through the return pipe or conduit 24 being controlled by a cooling water return valve 45.

In the construction of FIG. 5, cooling water from the source E from some other system such as, for example, an inplant service water and/or bearing cooling water, may be supplied to the first and second condensers 9, 12 when the condensing pump 16 is stopped during a short term outage threby reducing the power consumption of not only the circulating water pump 18 but also the condensate pump 16.

Figure 6:
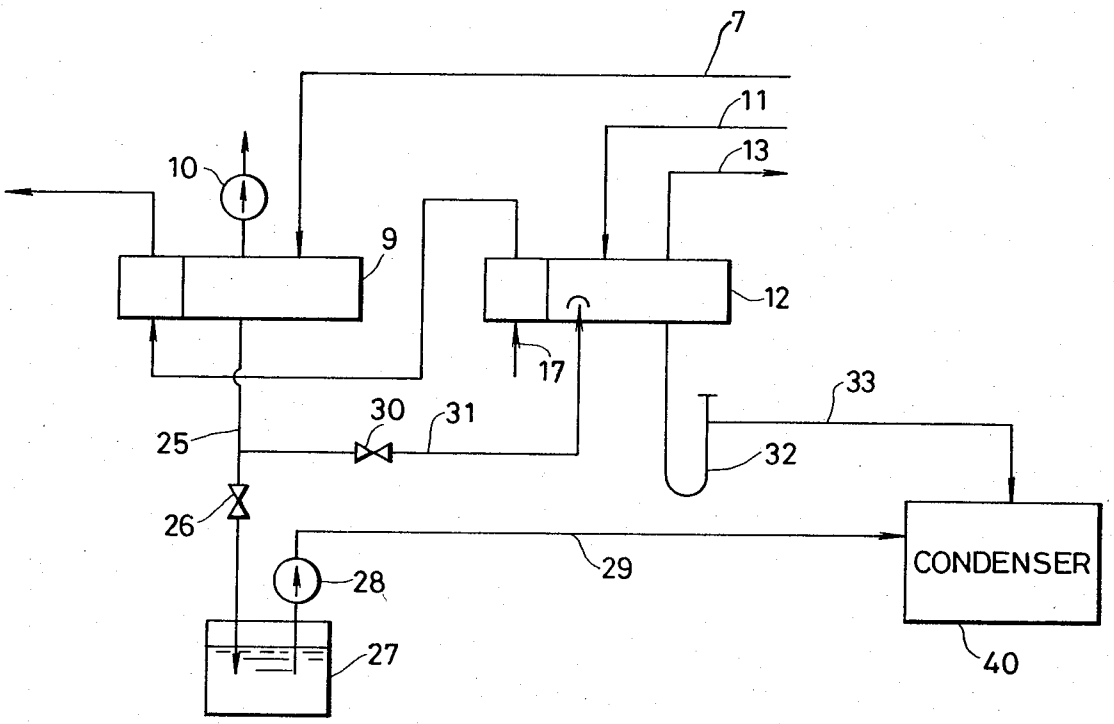
FIG. 6 is a schematic diagram of a further embodiment of a steam power plant equipped with a condenser vacuum retaining apparatus constructed in accordance with the present invention.

FIG. 6 provides another example of a construction in accordance with the present invention which is identical with respect to the above embodiments in its basic system but differs in that a drain from the first condenser 9 may be recovered and supplied to the second condenser 12. By virtue of this arrangement, a temperature of the drain recovered from the second condenser 12 to the condenser 40 is lowered threby preventing a rise in temperature of the condensate water stored within the condenser 40 threby avoiding a fear of occurrence of flush (self-evaporation) within the condenser 40 and further a reduction in the amount of saturated steam residing within condenser 40 as well as the low pressure turbine 1. Since the retention saturated steam in the condenser and the low pressure turbine may result into a condensation or dew formation on surface of metallic component members causing the development of corrosion, a reduction in the amount of resident saturated steam which is possible by the construction of FIG. 6 provides an overall corrosion resistance effect.

More particularly, in FIG. 6, when a regulating valve 30 is closed and a drain switching valve 26 is opened, the drainage from the gland condenser 9 flows into the condensate water recovering tank 27 through a drain pipe 25. The thus collected drainage may be sent to the condenser 40 through a condensate water recovery pipe 29 by way of a condensate water recovering pump 28. Alternatively, when the drain switching valve 26 is closed and the regulating valve 30 is opened, drainage from the gland condenser 9 is fed to the second gland condenser 12.

A difference in pressure between the second condenser 12 and the condenser 40 is relatively small so that a drainage of the second condenser 12 is introduced to the condenser 40 through a U-shaped sealing pipe 32 and a drain recovery pipe 33. Since the drainage of the gland condenser 9 has a temperature of about 100° C., the problem arises that if the drainage is directly sent to the condenser 40, it will be subjected to self-evaporation due to a change in pressure and the generated steam condensed into a dew or the like on the metallic surface of the condenser as well as the turbine thereby resulting in the development of corrosion. However, by virture of the introduction of the drainage of the first condenser 9 to the second condenser under less pressure and under a lower temperature near the saturation temperature under the inner pressure of the condenser 40 through a heat exchange with cooling water, it becomes possible to prevent not only a self-evaporation within the condenser 40 but also a dew condensation and corrosion resulting from such self-evaporation.

In each of the above described constructions, it is possible to obtain a condenser vacuum retaining apparatus for steam power plants which enables a retention of vacuum within the condenser 40 during short term outages or shutdowns by virtue of communicating a portion of a turbine gland packing near a condenser, as viewed with respect to a sealing steam supply portion, with an air extractor through a second gland condenser thus enabling sealing steam which would otherwise flow into the condenser 40 from the turbine gland packing 6 to be suctioned off into the second condenser 12 and the air extractor 15 during the short term outage or shutdown so as to prevent the sealing steam from leaking into the condenser 40. By virtue of the features of the present invention, operation of the circulating water pump 18 can be stopped during the short term outage or shutdown of the steam turbine to effect a saving in the power loss while nevertheless retaining the vacuum within the condenser 40 by a reduced power consumption. Thus, it becomes possible to avoid any disadvantages that result from a reduction or elimination of the vacuum within the condenser 40 during the short term outage or shutdown as well as, for example, adhesion of contaminants or pollutants in the coolant system which may result from the operation of the circulating water pump 18 with a reduced flow of water during the outage or shutdown.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A vacuum retaining arrangement for a steam power plant including a turbine means, a condenser means associated with said turbine means, means for extracting air from said condenser means, a gland packing means for enabling a forming of a steam seal for the turbine means, and first gland condenser means communicating with the gland packing means at a position spaced outwardly from a steam inlet port means for supplying the sealing steam to said gland packing means so as to enable steam extracted from said gland packing means to be supplied to said first gland condenser means to prevent a leaking of the sealing steam into atmosphere, the vacuum retaining arrangement comprising means connected to the gland packing means at a position near the condenser means for receiving sealing stream from said gland packing means, means for connecting said means for receiving to said means for extracting air from said condenser means for extracting the sealing steam from said gland packing means, and second gland condenser means interposed between said means for receiving and said means for extracting air from said condenser means for enabling steam extracted from said gland packing means to be supplied into said second gland condenser means to prevent a leaking of the sealing steam into said condenser means associated with said turbine means.

2. A vacuum retaining arrangement according to claim 1, wherein said second gland condenser means and said first gland condenser means being formed as an integral unit.

3. A vacuum retaining arrangement according to claim 2, wherein the integral unit is formed by an outer casing means having a partition means disposed therein for dividing the casing means into upper and lower chambers defining the respective gland condenser means, and means disposed in an interior of each of said chambers for receiving a coolant so as to enable a cooling of the respective gland condenser means.

4. A vacuum retaining arrangement according to claim 3, wherein the means for receiving a coolant includes a substantially U-shaped pipe means for receiving a condensate from the condenser means associated with the turbine means, the condensate forming the coolant for the respective gland condenser means.

5. A vacuum retaining arrangement according to claim 4, wherein means are connected to one of said gland condenser means for discharging non-condensed gas therefrom.

6. A vacuum retaining arrangement for a steam power plant including a turbine means, a condenser means associated with said turbine means, a gland packing means for enabling a forming of a steam seal for the turbine means, and first gland condenser means communicating with the gland packing means at a position spaced outwardly from a steam inlet port means for supplying the sealing steam to said gland packing means so as to enable steam extracted from said gland packing means to be supplied to said first gland condenser means to prevent a leaking of the sealing steam into atmosphere, the vacuum retaining arrangement comprising means connected to the gland packing means at a position near the condenser means for receiving sealing steam from said gland packing means, means connected to said means for receiving for extracting the sealing steam from said gland packing means, and second gland condenser means interposed between said means for receiving and said means for extracting for enabling steam extracted from said gland packing means to be supplied into said second gland condenser means to prevent a leaking of the sealing steam into said condenser means associated with said turbine means, and further comprising means for supplying a condensate from the condenser means associated with the turbine means to said second gland condenser means.

7. A vacuum retaining arrangement according to claim 6, wherein said means for supplying includes a condensate pipe means interposed between the second gland condenser means and the condenser means associated with the turbine means, pump means arranged in said condensate pipe means, and wherein means are provided for selectively controlling the supply of condensate to the second gland condenser means.

8. A vacuum retaining arrangement according to claim 7, further comprising means for supplying a coolant to said gland condenser means including means for selectively controlling the supply of the coolant.

9. A vacuum retaining arrangement according to claim 8, wherein said means for selectively controlling the supply of condensate includes a first valve means arranged in the condensate pipe means, said means for supplying a coolant includes a coolant source, a coolant supply pipe interposed between the coolant source and the condensate pipe means, said coolant supply pipe communicating with the condensate pipe means at a position between the first valve means and said second gland condenser means, and said means for controlling the supply of coolant includes a second valve means arranged between the condensate pipe means and the coolant source.

10. A vacuum retaining arrangement according to claim 9, wherein said second gland condenser means and said first gland condenser means being formed as an integral unit.

11. A vacuum retaining arrangement according to claim 10, wherein said integral unit is formed by an outer casing means having a partition means disposed therein for dividing the casing means into upper and lower chambers defining the respective gland condenser means, and means disposed in an interior of each of said chambers for receiving a coolant so as to enable a cooling of the respective gland condenser means.

12. A vacuum retaining arrangement according to claim 6, wherein the steam power plant includes another gland condenser means communicating with the gland packing means at a position spaced outwardly from a steam inlet port means for supplying the sealing steam to said gland packing means, said gland condenser means of the vacuum retaining arrangement and said another gland condenser means being formed as an integral unit.

13. A vacuum retaining arrangement according to claim 1, wherein means are provided for selectively supplying condensate from the first gland condenser means to a condensate recovery tank and to said second gland condenser means of the vacuum retaining arrangement.

14. A vacuum retaining arrangement for a steam power plant including a turbine means, a condenser means associated with said turbine means, a gland packing means for enabling a forming of a steam seal for the turbine means, and first gland condenser means communicating with the gland packing means at a position spaced outwardly from a steam inlet port means for supplying the sealing steam to said gland packing means so as to enable steam extracted from said gland packing means to be supplied to said first gland condenser means to prevent a leaking of the sealing steam into the atmosphere, the vacuum retaining arrangement comprising means connected to the gland packing means at a position spaced inwardly from said steam inlet port means and near the condenser means for receiving sealing steam from said gland packing means, means connected to said means for receiving for extracting the sealing steam from said gland packing means, and second gland condenser means interposed between said means for receiving and said means for extracting for enabling steam extracted from said gland packing means to be supplied into said second gland condensor means to prevent a leaking of the sealing steam into said condenser means associated with said turbine means.

* * * * *